US006302502B1

(12) United States Patent
Larsen, Jr.

(10) Patent No.: US 6,302,502 B1
(45) Date of Patent: Oct. 16, 2001

(54) MOUNTING BRACKET FOR A TONGUELESS DRAWER GUIDE

(76) Inventor: Joseph B. Larsen, Jr., 1221 Claxton Ridge Dr., Kernersville, NC (US) 27284

( * ) Notice: Subject to any disclaimer, the term of this patent is extended or adjusted under 35 U.S.C. 154(b) by 0 days.

(21) Appl. No.: 09/562,690

(22) Filed: May 2, 2000

(51) Int. Cl.[7] ..... A47B 88/04

(52) U.S. Cl. ..... 312/334.4; 312/330.1; 312/334.5; 211/123; 248/254

(58) Field of Search ..... 312/334.5, 334.27, 312/334.23, 334.7, 348.1, 348.2; 248/230.2, 254, 262, 314; 211/105.1, 123

(56) References Cited

U.S. PATENT DOCUMENTS 4,244,546 1/1981 Mertes et al. .
4,501,453 * 2/1985 Gutner et al. ..... 312/330.1 X
5,306,080 4/1994 Lautenschläger et al. .
5,349,723 9/1994 Domenig .
5,549,376 * 8/1996 Domenig ..... 312/334.5
5,636,820 6/1997 Domenig .
5,746,490 5/1998 Domenig .
5,823,648 10/1998 Domenig .

* cited by examiner

*Primary Examiner*—Peter M. Cuomo
*Assistant Examiner*—Michael J. Fisher

(57) ABSTRACT

A laterally adjustable mounting bracket for use with a tongueless drawer guide, comprising a mounting plate and a hollow central elongate member connected at one end to the front face of the mounting plate. An opening in one end of the central elongate member opposite the mounting plate connection is adapted to receive a tongueless drawer guide. The opening is designed to maintain tension on the drawer guide, such that the drawer guide remains relatively secure after adjustment to a particular position. This is accomplished by a tab which is deflected slightly inward toward the interior of the opening, and which is somewhat displaced when a drawer guide is inserted.

9 Claims, 2 Drawing Sheets

MOUNTING BRACKET FOR A TONGUELESS DRAWER GUIDE

BACKGROUND OF THE INVENTION

1. Field of the Invention.

The present invention relates to adjustable mounting brackets for securing drawer guides to desk or cabinet members, and more particularly to a new and improved adjustable mounting bracket for use with tongueless drawer guides.

2. Description of the Prior Art

Various types of adjustable mounting brackets are used to provide some lateral adjustment for drawers housed by desk or cabinets to enable proper alignment of the drawers within the housing and the smooth and efficient operation thereof thereafter. For the most part, these prior art devices are simply constructed without any precise adjustment means, wear quickly, and thus provide inadequate functional assistance soon after installation. Other prior art devices are simple in design, but fail to provide adequate security when the drawer guide is being held in a particular desire position. Various other attempted solutions have involved complicated designs requiring complex manufacturing methods.

Since the prior art is comprised mostly of either simply designed and manufactured adjustable brackets characterized by the inadequacies noted above, or complicated designs requiring complex manufacturing methods, it can be appreciated that there is a continuing need for improvements to such devices. In particular, there exists a need for a bracket of simple design and ease of manufacture, yet allowing the secure, durable positioning of drawer guides. The present invention addresses the need for such improvements.

SUMMARY OF THE INVENTION

The general purpose of the present invention, which will be described subsequently in greater detail, is to provide a new and improved adjustable mounting bracket which has all of the advantages of prior art brackets and none of the disadvantages.

It is therefore an object of the present invention to provide a new and improved adjustable mounting bracket to enable secure and continuously variable lateral adjustment between a drawer guide carrying the drawer and the desk or cabinet in which the drawer resides.

It is another object of the present invention to provide a new and improved adjustable mounting bracket that is more simply designed and which provides greater security in particular positions than prior art devices and that will function with greater longevity than prior art devices. It is yet still another further object of the present invention to provide a new and improved adjustable mounting bracket that will operate with more efficiency, can be adjusted with greater variability, and can be produced more economically than prior art devices.

Accordingly, in one aspect the invention relates to a laterally adjustable mounting bracket for use with a tongueless drawer guide, the bracket comprising: a mounting plate having a front face and a rear face releasably secured to a supporting surface; a hollow central elongate member connected at one end to the front face of said mounting plate; wherein the central elongate member comprises an opening at its end distal to its connection to the front face of the mounting plate, the opening comprising a tab deflected slightly inward toward the interior of the opening.

There has been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangement of the components set forth in the following description or illustrated in the drawings. The invention is capable of other embodiments and of being practiced and carried out in various ways. It is to be understood that the phraseology and terminology employed herein are for the purpose of description and should not be regarded as limiting. As such, those skilled in the art will appreciate the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention. The abstract is neither intended to define the invention of the application, which is measured by the claims, nor is it intended to be limiting as to the scope of the invention in any way.

These, together with other objects of the invention, along with the various features of novelty which characterize the invention, are pointed out with particularity in the claims annexed to and forming a part of this disclosure. For a better understanding of the invention, its operating advantages and the specific objects attained by its uses, reference is made to the accompanying drawings and descriptive matter in which like characters of reference designate like parts throughout the several views.

BRIEF DESCRIPTION OF THE DRAWINGS

The invention will be better understood and objects other than those set forth above will be become apparent when consideration is given to the following detailed description. Such description makes reference to the annexed drawings wherein.

DETAILED DESCRIPTION OF THE INVENTION

Figure 1:
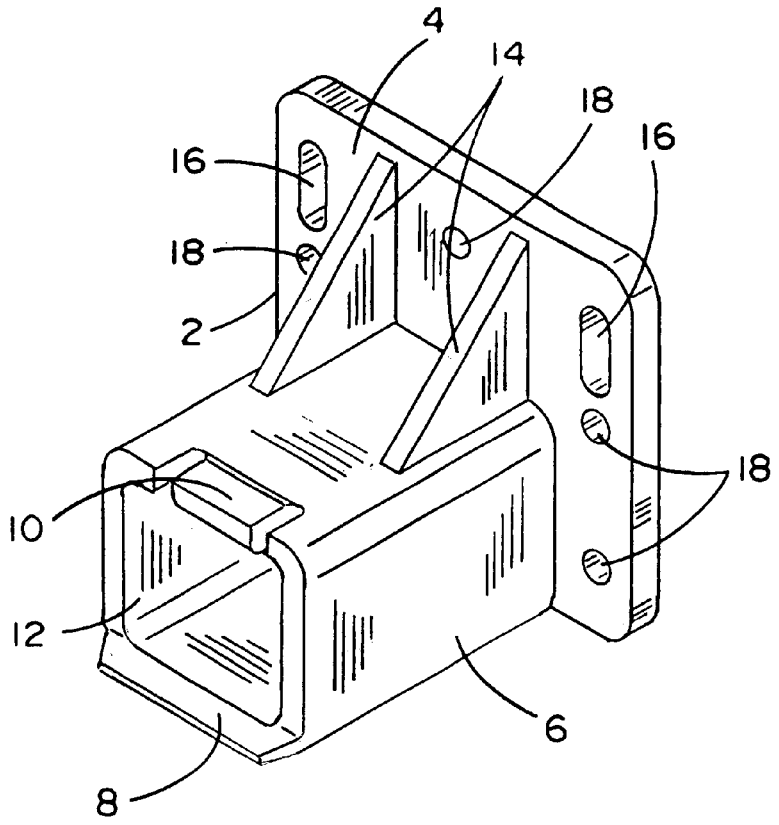
FIG. 1 is a perspective view of the mounting bracket comprising one embodiment of the present invention.

It is one object of the present invention to provide a new and improved adjustable mounting bracket to enable secure and continuously variable lateral adjustment between a tongueless drawer guide carrying the drawer and the desk or cabinet in which the drawer resides.

It is another object of the present invention to provide a new and improved adjustable mounting bracket that is more simply designed and which provides greater security in particular positions than prior art devices and that will function with greater longevity than prior art devices. It is yet still another further object of the present invention to provide a new and improved adjustable mounting bracket that will operate with more efficiency, can be adjusted with greater variability, and can be produced more economically than prior art devices.

Accordingly, in one aspect the invention relates to a laterally adjustable mounting bracket for use with a tongueless drawer guide, the bracket comprising: a mounting plate having a front face and a rear face releasably secured to a supporting surface; a hollow central elongate member connected at one end to the front face of said mounting plate; wherein the central elongate member comprises an opening at its end distal to its connection to the front face of the mounting plate, the opening comprising a tab deflected slightly inward toward the interior of the opening. More preferably, the central elongate member is substantially rectangular in cross-section. Also more preferably, the mounting plate comprises at least one aperture for receiving a fastener adapted to secure the mounting plate to a furniture member. Also more preferably, the opening further comprises a ramp connected to a side of the opening opposite the position of the tab.

In another preferred embodiment, the mounting bracket further comprises at least one buttress member connecting at least one side of the central elongate member to the front face of the mounting plate. More preferably, two parallel buttress members connect a side of the central elongate member to the front face of the mounting plate, the side being defined by the position of the tab.

In another preferred embodiment, the mounting plate comprises at least one aperture is elongate, thereby allowing vertical adjustment of the position of the mounting bracket with respect to the furniture member without complete removal of the fastener. Most preferably, the mounting plate comprises a plurality of apertures for receiving fasteners, and wherein at least one of the apertures is elongate and at least one of the apertures is substantially circular and substantially the same diameter as a fastener to be received therein.

In another aspect, the invention relates to a laterally adjustable mounting bracket for use with a tongueless drawer guide, wherein the bracket comprises a substantially rectangular mounting plate having a front face and a rear face releasably secured to a supporting surface, wherein the mounting plate comprises a plurality of apertures for receiving fasteners, and wherein at least one of the apertures is elongate and at least one of the apertures is substantially circular and substantially the same diameter as a fastener to be received therein; a hollow central elongate member, substantially rectangular in cross-section, connected at one end to a front face of the mounting plate, wherein the central elongate member comprises an opening at its end distal to its connection to the front face of the mounting plate, the opening comprising a tab deflected slightly inward toward the interior of the opening, and a ramp connected to a side of the opening opposite the position of the tab; and two parallel buttress members connect a side of the central elongate member to the front face of the mounting plate, the side being defined by the position of the tab.

With reference now to the drawings and in particular to FIG. 1, one embodiment of the invention is shown in perspective view. Mounting bracket 2 is shown comprising primarily mounting plate 4 and central member 6. The junction of mounting plate 4 and central member 6 in the embodiment shown is continuous, that is the mounting bracket 2 is manufactured in one piece, for example as a molded plastic. The connection between mounting plate 4 and central member 6 is further strengthened by buttress members 14.

Mounting plate 4 is characterized by apertures 18 which may receive fasteners such as screws for securing mounting bracket 2 to a desk or cabinet member at the rear of an cavity which receives a drawer and drawer guide therein. Mounting plate 4 is also comprises elongate apertures 16, which allow for initial vertical adjustment by the loosening of fasteners therein, while still securing mounting bracket 2 to a furniture member. In one embodiment, as shown in FIG. 1, both elongate apertures 16 and circular apertures 18, substantially the same diameter as a fastener to be inserted therethrough, are provided in mounting plate 4. The elongate apertures 16 may be used to initially secure and position the mounting bracket on a furniture member, while the circular apertures 18 receive fasteners to secure the mounting bracket in its final position.

Central member 6 comprises a hollow elongate section, shown here as substantially rectangular in cross section. Opening 12 is shown at the end of central member 6 opposite its connection to mounting plate 4. Opening 12 receives a drawer guide 22 (see FIG. 4) which is less wide than opening 12 by a distance which is the desired measure of adjustment between the drawer guide 22 and mounting bracket 2.

Opening 12 comprises opposing tab 10 and ramp 8. Tab 10 is deflected from the plane formed by the top side of central member 6, as shown in FIG. 1. Ramp 8, also shown in the side view of FIG. 2, facilitates insertion of the drawer guide 22 into opening 12. As drawer guide 22 is inserted into opening 12, tab 10 is deflected upward and maintains pressure on drawer guide 22. Thus, tab 10 provides frictional resistance to inadvertent lateral movement of drawer guide 22 within opening 12.

Figure 2:
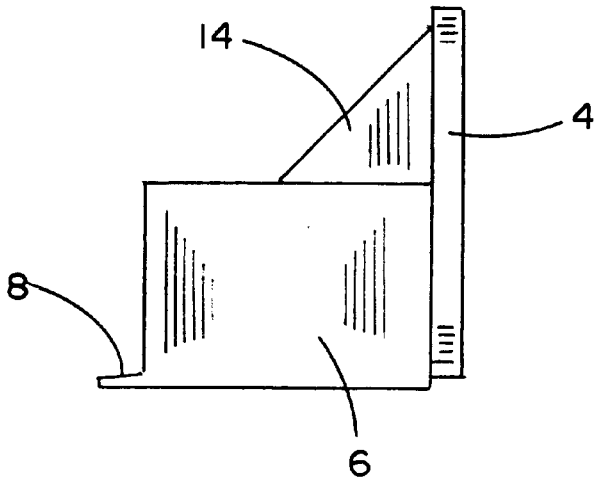
FIG. 2 is a side elevational view of the mounting bracket shown in FIG. 1.

FIG. 2 is a side elevational view of mounting bracket 2, showing ramp 8, central member 6, buttress 14 and mounting plate 4 are shown.

Figure 3:
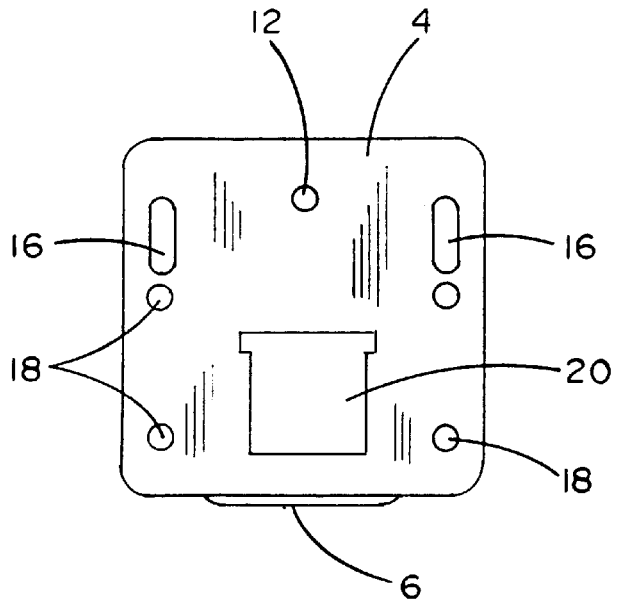
FIG. 3 is a rear elevational view of the mounting bracket shown in FIG. 1.

FIG. 3 is a rear elevational view of mounting plate 2, showing in addition to features already discussed, opening 20, which is provided for use during the manufacture of the mounting bracket.

Figure 4:
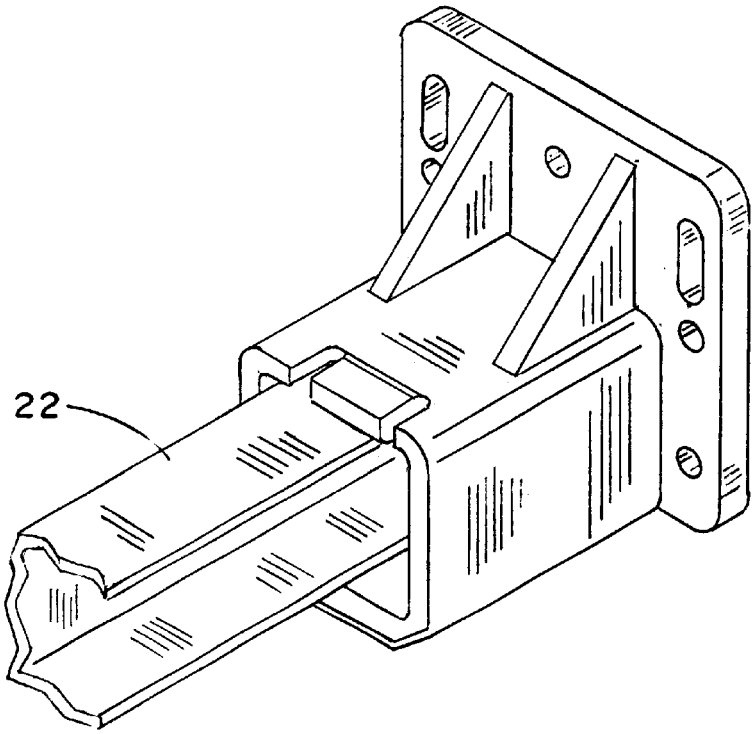
FIG. 4 is a perspective and fragmentary view of a drawer guide cooperating with the present invention to provide lateral adjustment of a desk or cabinet drawer.

FIG. 4 is a perspective view of mounting bracket 2 as shown in FIG. 1, together with drawer guide 22 as when the drawer guide is mounted for use with a drawer and an associated desk or cabinet.

With respect to the description set forth above, the optimum dimensional relationship for the pans of the invention, to include variations in size, materials, shape, form, function, and manner of operation, assembly and use, are deemed readily apparent and obvious to one skilled in the art, and all equivalent relationships to those illustrated in the drawings and described in the specification are intended to be encompassed herein. The foregoing is considered as illustrative only of the principles of the invention. Since numerous modifications and changes will readily occur to those skilled in the art, it is intended not to limit the invention to the exact construction and operation shown and described. All suitable modifications and equivalents that fall within the scope of the appended claims are deemed within the present inventive concept.

What is claimed is:

1. A laterally adjustable mounting bracket for use with a tongueless drawer guide, said bracket comprising:

a mounting plate having a front face and a rear face releasably secured to a supporting surface;

a hollow central elongate member connected at one end to said front face of said mounting plate;

wherein said central elongate member comprises an opening at its end distal to its connection to said front face of said mounting plate, said opening comprising a single tab that is spaced apart from the front face of the mounting plate and deflected slightly inward toward the interior of said opening and that is deflectable upward away from the interior of the opening and adapted to maintain pressure on the tongueless drawer guide and to provide frictional resistance to inadvertent lateral movement of the tongueless drawer guide within the opening.

2. The mounting bracket of claim 1, wherein said opening further comprises a ramp connected to a side of said opening opposite the position of said tab.

3. The mounting bracket of claim 1, further comprising at least one buttress member connecting at least one side of the central elongate member to the front face of the mounting plate.

4. The mounting bracket of claim 3, wherein two parallel buttress members connect a side of the central elongate member to the front face of the mounting plate, said side being defined by the position of said tab.

5. The mounting bracket of claim 1, wherein said central elongate member is substantially rectangular in cross-section.

6. The mounting bracket of claim 1, wherein said mounting plate comprises at least one aperture for receiving a fastener adapted to secure said mounting plate to a furniture member.

7. The mounting bracket of claim 6, wherein said at least one aperture is elongate, thereby allowing vertical adjustment of the position of the mounting bracket with respect to said furniture member without complete removal of said fastener.

8. The mounting bracket of claim 6, wherein said mounting plate comprises a plurality of apertures for receiving fasteners, and wherein at least one of said apertures is elongate and at least one of said apertures is substantially circular for receiving a fastener therein.

9. A laterally adjustable mounting bracket for use with a tongueless drawer guide, said bracket comprising:

a substantially rectangular mounting plate having a front face and a rear face releasably secured to a supporting surface, wherein said mounting plate comprises a plurality of apertures for receiving fasteners, and wherein at least one of said apertures is elongate and at least one of said apertures is substantially circular for receiving a fastener therein;

a hollow central elongate member, substantially rectangular in cross-section, connected at one end to a front face of said mounting plate, wherein said central elongate member comprises an opening at its end distal to its connection to said front face of said mounting plate, said opening comprising a single tab that is spaced apart from the front face of the mounting plate and deflected slightly inward toward the interior of the opening and that is deflectable upward away from the interior of the opening and adapted to maintain pressure on the tongueless drawer guide and to provide frictional resistance to inadvertent lateral movement of the tongueless drawer guide within the opening, and a ramp connected to a side of said opening opposite the position of said tab; and two parallel buttress members connect a side of the central elongate member to the front face of the mounting plate, said side being defined by the position of said tab.

* * * * *